United States Patent [19]

Ziolo

[11] 4,245,026

[45] Jan. 13, 1981

[54] PRODUCTION OF LOW DENSITY COATED MAGNETIC POLYMER CARRIER PARTICULATE MATERIALS

[75] Inventor: Ronald F. Ziolo, Webster, N.Y.

[73] Assignee: Xerox Corporation, Stamford, Conn.

[21] Appl. No.: 107,281

[22] Filed: Dec. 26, 1979

[51] Int. Cl.[3] ..... G03G 9/14; B05D 7/00

[52] U.S. Cl. ..... 430/137; 430/108; 427/222; 427/229

[58] Field of Search ..... 427/222, 217, 229; 430/137, 107, 108; 428/403

[56] References Cited

U.S. PATENT DOCUMENTS

| | | | |
|---|---|---|---|
| 3,342,587 | 9/1957 | Goodrich et al. | 427/217 X |
| 3,535,149 | 10/1970 | Dunn et al. | 427/229 X |
| 3,900,646 | 8/1975 | Clyde | 427/229 X |

*Primary Examiner*—John D. Welsh

[57] ABSTRACT

Electrostatographic carrier materials having low bulk densities and high magnetic permeabilities are obtained by impregnating low density imbibitive polymer particles with magnetic or magnetically attractable metal or metal oxide. The low density magnetic composite carrier particles are prepared by the solution phase thermal decomposition of transition metal carbonyls in the presence of the polymer particles with a suitable suspending medium. Air and moisture are excluded from the reaction vessel and the contents are heated with stirring so that the carbonyl boils and the mixture is refluxed until the temperature rises to that of the suspending medium whereupon the polymer particles are impregnated within their pores with elemental metal. The mixture is cooled, the beads washed, air dried, and recovered. When mixed with toner particles and employed in electrostatographic development of electrostatic latent images, the aforementioned carrier materials provide significantly reduced toner impaction levels and longer useful life.

10 Claims, No Drawings

PRODUCTION OF LOW DENSITY COATED MAGNETIC POLYMER CARRIER PARTICULATE MATERIALS

This invention relates in general to electrophotography, and more particularly, to a process for preparing carrier materials useful in the magnetic brush type development of electrostatic latent images.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,522 is known as "cascade" development. In this method, a developer material comprising relatively large carrier particles having finely-divided toner particles electrostatically clinging to the surface of the carrier particles is conveyed to and rolled or cascaded across the electrostatic latent image bearing surface. The composition of the toner particles is so chosen as to have a triboelectric polarity opposite that of carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brushlike configuration. This "magnetic brush" is engaged with an electrostatic image bearing surface and the toner particles are drawn from the brush to the electrostatic image by electrostatic attraction.

In magnetic brush development of electrostatic latent images, the developer is commonly a triboelectric mixture of finely-divided toner powder comprised of dyed or pigmented thermoplastic resin mixed with coarser carrier particles of a soft magnetic material such as "ground chemical iron" (iron filings), reduced iron oxide particles or the like. The conductivity of the ferromagnetic carrier particles which form the "bristles" of a magentic brush provides the effect of a development electrode having a very close spacing to the surface of the electrophotographic element being developed. By virtue of this development electrode effect, it is possible to develop part of the tones in pictures and solid blacks as well as line copy. Magnetic brush development sometimes makes this mode of developing advantageous where it is desired to copy materials other than simply line copy.

While ordinarily capable of producing good quality images, conventional developing materials suffer serious deficiencies in certain areas. Some developer materials, though possessing desirable properties such as proper triboelectric characteristics, are unsuitable because they tend to cake, bridge and agglomerate during handling and storage. Furthermore, with some polymer coated carrier materials, flaking of the carrier coating will cause the carrier to have non-uniform triboelectric properties when the carrier core is composed of a material different from the surface coating thereon. This results in non-uniform pickup of toner by the carrier and non-uniform deposition of toner on the image causing imperfections in the copy image. In addition, the coatings of most carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating material which fails upon impact and abrasive contact with machine parts and other carrier particles. Carriers having coatings which tend to chip and otherwise separate from the carrier core or substrate must be frequently replaced thereby increasing expense and causing loss of productive time. Print deletion and poor print quality occur when carriers having damaged coatings are not replaced. Fines and grit formed from carrier disintegration tend to drift to and form undesirable and damaging deposits on critical machine parts.

Another factor affecting the stability of the triboelectric properties of carrier particles is the susceptibility of carrier particles to "toner impaction". When carrier particles are employed in automatic machines and recycled through many cycles, the many collisions which occur between the carrier particles and other surfaces in the machine cause the toner particles carried on the surface of the carrier particles to be welded or otherwise forced into the carrier surfaces. The gradual accumulation of impacted toner material on the surface of the carrier causes a change in the triboelectric value of the carrier and directly contributes to the degradation of copy quality by eventual destruction of the toner carrying capacity of the carrier. This problem is especially aggravated when the carrier particles, and particularly the carrier cores, are prepared from materials such as iron or steel having a high specific gravity or density since during mixing and the development process the toner particles are exposed to extremely high impact forces from contact with the carrier particles. It is apparent from the descriptions presented above, as well as in other development techniques, that the toner particles are subjected to severe physical forces which tend to break down the particles into undesirable dust fines which become impacted onto carrier particles. Thus, there is a continuing need for a better developer material for developing electrostatic latent images.

It is therefore an object of this invention to provide electrostatographic developer materials which overcome the above-noted deficiencies.

It is another object of this invention to provide a process for preparing magnetically responsive carrier particles which exert reduced forces upon toner particles.

It is another object of this invention to provide low density magnetic composite carrier particles possessing improved resistance to abrasion when employed in electrostatographic development of electrostatic latent images.

A further object of this invention is to provide improved developer compositions for use in magnetic brush development.

A still further object of this invention is to provide lower density carrier materials having a magnetic response.

It is another object of this invention to provide developer materials having physical and electrostatographic properties superior to those of known developer materials.

The above objects and others are accomplished in accordance with this invention, generally speaking, by impregnating low density imbibitive polymer particles with a magnetic or magnetically attractable metal or metal oxide to provide electrostatographic carrier particles which have a low bulk density and a high magnetic permeability. More specifically, low density magnetic composite electrostatographic carrier particles are prepared by the solution phase thermal decomposition of transition metal carbonyls in the presence of low density imbibitive or microporous polymer substrates. Since the polymer substrates are imbibitive or microporous, the polymer substrates are metallized internally and the magnetic or magnetically attractable metal or metal oxide formed during the thermal decomposition of the aforementioned carbonyls extends to the interior of the polymer substrates. Due to the structure of the carrier product formed, the carrier material, in addition to possessing magnetic properties, is highly resistant to abrasion loss of magnetic or magnetically attractable metal or metal oxide component thus providing substantial advantages in carrier useful life since the magnetic component extends to the interior of the carrier particles. Magnetically, these composite structures respond like a collection of solid, fine iron particles but, when employed in electrostatographic magnetic brush development systems, form more uniform and "softer" magnetic brushes due to their very low bulk densities which in some cases are more than an order of magnitude less than the density of iron.

Generally speaking, the low density magnetic composite carrier particles are prepared by metallizing the polymer beads electrolessly by the thermal decomposition of a transition metal carbonyl to the elemental metal or metal oxide in the presence of the beads with a suitable suspending medium. More specifically, the polymer beads are impregnated with magnetic iron or its magnetic oxidized salts by placing them in a suitable vessel with iron pentacarbonyl and a suspending medium such as n-octane. Air and moisture are excluded by displacement with a dry inert gas such as nitrogen, and the contents are heated and stirred so that the iron pentacarbonyl boils, and the mixture is refluxed until the temperature rises to that of the suspending medium whereupon impregnation of the beads with iron or its oxides is complete. The mixture is then cooled, the beads are washed with fresh suspending medium, and with diethyl ether to remove any fines, air dried with heat and vibration, and the beads recovered. The magnetic low density particles obtained typically are dull black to gray in color depending upon metallic loading.

Generally, the thermal decomposition of typical transition metal carbonyls may be exemplified by the following equations for (1) iron pentacarbonyl, and (2) nickel tetracarbonyl:

$$Fe(CO)_5 \overset{\Delta}{\rightleftharpoons} Fe + 5CO \quad (1)$$

$$Ni(CO)_4 \overset{\Delta}{\rightleftharpoons} Ni + 4CO \quad (2)$$

The decomposition of the transition metal carbonyls is performed in the presence of the polymer substrates and utilized to prepare composite materials having both chemical and mechanical stability and which display gross magnetic behavior. Substrate configuration is changed following the impregnation process. That is, the original morphology of the polymer substrates is that of small spheres or beads. The particles are typically solid with essentially no pores or voids such as in the sponge. However, during the preparation steps of the composite magnetic particles of this invention, the suspending medium and the elemental metal or metal oxide formed in the thermal decomposition of the transition metal carbonyl penetrate the polymer network causing the polymer beads to swell in size to up to about three times their original diameter. After removal of the suspending medium from the beads by heated air drying while vibrating the beads to avoid agglomeration, the composite magnetic particles have the appearance, morphology and texture of dried raisins or prunes. That is, the composite magnetic particles are irregularly shaped bodies having numerous convolutions. Since the composite magnetic carrier particles have numerous convolutions, they have a high surface area with a large number of open pockets for carrying finely-divided toner particles. The bulk magnetic response of the composite materials may be controlled by varying the mass of the magnetic metal of metal oxide in proportion to the particle mass.

Any suitable magnetic or magnetically attractable transition metal may be employed to impregnate the polymer substrates of the low density magnetic composite carrier particles of this invention. Typical such transition metals or their oxides may be provided from iron pentacarbonyl, di-iron nonacarbonyl, tri-iron dodecacarbonyl, iron carbonyl cluster compounds, dicobalt octacarbonyl, nickel tetracarbonyl, any thermally extrudable compounds of such transition metals and organometallic compounds, and mixtures thereof.

Any suitable low density imbibitive or impregnatable polymer material may be employed as the substrate for the composite magnetic or magnetically attractable carrier particles of this invention. Typical low density polymer materials include particles in various forms such as foam polymer nodules, solid polymer beads, microporous polymer beads and polymer chips. However, it is preferred that the polymer materials be selected from imbiber polymer beads such as those available from the Dow Chemical Company, Midland, Mich. Thus, a wide variety of particulate, low density polymer materials the surfaces and interiors of which can be impregnated with a magnetic or magnetically attractable transition metal or metal oxide may be employed in accordance with this invention. As indicated, the composite low density magnetic composition of this invention may vary in size and shape. However, it is preferred that the composite material have an irregular shape without rough edges or protrusions which have a tendency to abrade more easily. Particularly useful results are obtained when the composite material has an average particle size from about 30 microns to about 300 microns, although satisfactory results may be obtained when the composite material has an average particle size of from between about 10 microns and about 850 microns. The size of the carrier particles employed will, of course, depend upon several factors, such as the type of images ultimately developed, the machine configuration and so forth.

The imbibitive polymer materials employed as the substrate for the composite magnetic carrier particles of this invention may have any suitable bulk density. However, it is preferred that the polymer material have an average bulk density of between about 0.95 and about 1.05 gram/cm$^3$ because stress levels are substantially reduced thereby reducing toner impaction and developer degradation.

The low density polymer material employed as the substrate for the composite carrier particles of this invention may have a smooth surface, it may have cracks or fissures in the surface, and it may be porous. However, the polymer material must be imbibitive or be capable of imbibing the suspending medium and the elemental metal or metal oxide found in the thermal decomposition of the transition metal carbonyl. When the polymer substrate is imbibitive, the magnetic metal or metal oxide is deposited within the carrier beads in the form of continuous or discontinuous films which provides a practical advantage in that the magnetic component is well protected against abrasion. As long as the magnetic metal or metal oxide is deposited in the surface of the polymer bead or is impregnated in the interior of the beads and allows effective magnetic field extension across the gap between the beads, it does not matter as to their performance as magnetic brush development carrier particles. A range of mass ratios of polymer material to magnetic elemental metal or metal oxide that will provide satisfactory magnetically responsive composite carrier particles is from between about 1:0.3 to 1:1.

To achieve further variation in the properties of the low density magnetic composite carrier particles of this invention, well known insulating polymeric resin coating materials may be applied thereto. That is, it may be desirable for some applications to alter and control the triboelectric properties of the magnetic composite carrier particles of this invention. Thus, this may be accomplished by applying thereto typical insulating carrier coating materials as described by L. E. Walkup in U.S. Pat. No. 2,618,551; B. B. Jacknow et al in U.S. Pat. No. 3,526,533; and R. J. Hagenbach et al in U.S. Pat. Nos. 3,533,835 and 3,658,500. Typical electrostatographic carrier particle coating materials includes vinyl chloride-vinyl acetate copolymers, poly-p-xylylene polymers, styrene-acrylate-organosilicon terpolymers, natural resins such as caoutchouc, colophony, copal, dammar, Dragon's Blood, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates; thermosetting resins including phenolic resins such as phenolformaldehyde, phenolfurfural and resorcinol formaldehyde; amino resins such as ureaformaldehyde and melamineformaldehyde; polyester resins; epoxy resins; and the like.

When the magnetic composite carrier particles of this invention are overcoated with an insulating resinuous material any suitable electrostatographic carrier coating thickness may be employed. However, a polymeric coarting having a thickness at least sufficient to form a thin continuous film on the carrier particle is preferred because the carrier coating will then possess sufficient thickness to resist abrasion and prevent pinholes which adversely affect the triboelectric properties of the coating carrier particles. Generally, for cascade and magnetic brush development, the carrier coating may comprise from about 0.1 percent to about 10.0 percent by weight based on the weight of the coated composite carrier particles. Preferably, the carrier coating should comprise from about 0.1 percent to about 1.0 percent by weight based on the weight of the coated carrier particles because maximum durability, toner impaction resistance, and copy quality are achieved.

Any suitable dispersing or suspending medium may be employed in the thermal decomposition process of preparing the low density magnetic composite carrier particles of this invention. Typical dispersing and suspending mediums may be hydrocarbon solvents with boiling points preferably above the decomposition temperature of the transition metal compound employed. Satisfactory results have been obtained with n-octane.

Any suitable well known toner material may be employed with the low density composite carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, polypropylene resins, epoxy resins, polyethylene resins, polyester resins, and mixtures thereof. The particular toner material to be employed obviously depends upon the separation of the toner particles from the magnetic carrier in the triboelectric series and should be sufficient to cause the toner particles to electrostatically cling to the carrier surface. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 1 and 30 microns.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Green Ozalate, lampblack, Rose Bengal, Monastral Red, Sudan Black BM, and mixtures thereof. The pigment or dye should be present in a quality sufficient to render it highly colored so that it will form a clearly visible image on a recording member. Preferably, the pigment is employed in an amount from about 3 percent to about 20 percent by weight based on the total weight of the colored toner because high quality images are obtained. If the toner colorant employed is a dye, substantially smaller quantities of colorant may be used.

Any suitable conventional toner concentration may be employed with the low density magnetic carriers of this invention. Typical toner concentrations for development systems include about 1 part toner with about 10 to about 200 parts by weight of carrier.

The carrier materials of the instant invention may be mixed with finely-divided toner particles and employed to develop electrostatic latent images on any suitable electrostatic latent image bearing surface including conventional photoconductive surfaces. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium tri-sulfide, gallium selenide arsenic disulfide, arsenic trisulfide, aresenic triselenide, antimony trisulfide, cadmium sulfoselenide, and mixtures thereof. Typical organic photoconductors include: quinacridone pigments, phthalocyanine pigments, triphenylamine, 2,4'-bis(4,4'-diethylaminophenol)-1,3,4-oxadiazol, N-isopropylcarbazole, triphenylpyrrole, 4,5-diphenylimidazolidinone, 4,5-diphenylimidazolidinethione, 4,5-bis-(4'-aminophenyl)-imidazolidinone, 1,4'-dicyanonaphthalene, 1,4-dicyanonaphthalene, aminophthalocinitrile, nitrophthalodinitrile, 12,3,5,6-tetra-azacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylaminobenzylidene-benzhydrazide, 3-benzylidene-aminocarbazole, polyvinyl carbazole (2-nitrobenzylidene)-p-bromoaniline, 2,4-diphenyl-quinazoline, 1,2,4-triazine, 1,3-diphenyl-3-methylpyrazoline, 2-(4'-dimethylamino phenyl)-benzoxazole, 3-amine-carbazole, and mixtures thereof. Representative patents in which photoconductive materials are disclosed include U.S. Pat. No. 2,803,542 to Ullrich, U.S. Pat. No. 3,121,007 to Middleton, and U.S. Pat. No. 3,151,982 to Corrsin.

The low density magnetic carrier materials produced by the process of this invention provide numerous advantages when employed to develop electrostatic latent images. For example, when mixed with an appropriate toner material, the resultant developer composition is found to generate greatly reduced stress levels and consequently much lower toner impaction levels than previously known magnetic brush development developer compositions. Further, such developer compositions are found to provide low background densities, higher image resolutions, and greatly improved overall print qualities. The composite carrier materials of this invention have a slightly yielding surface which reduces particle abrasion and also minimizes toner impaction. When contact occurs, the particle surface yields thus massaging the particle convolutions and aids in the release of toner particles from the carrier surface. The composite carrier materials possess a unique combination of morphology, texture and low density adding up to a highly improved magnetic carrier particle.

The following examples further define, describe, and compare preferred methods of preparing and utilizing the low density magnetic particles of the present invention in electrostatographic applications. Parts and percentages are by weight unless otherwise indicated.

In the following example, iron pentacarbonyl (99.5 percent purity) was obtained from Ventron Corporation, Danvers, Mass. and filtered before use to remove iron oxides. N-octane (gold label grade) was obtained from Aldrich Chemical Company, Milwaukee, Wis. and used as received. Dicobalt octacarbonyl was obtained from Strem Chemical Company, Andover, Mass. Polymer beads were obtained under the tradename "Imbiber Polymer Beads" and used as received. The polymer beads were manufactured by Dow Chemical Company, Midland, Mich. These polymer beads are essentially spherical and have an average particle size of about 100, 350 and 550 microns. Under favorable conditions these beads have the ability to swell or increase in diameter up to three times their original diameter and absorb various solvents, elements and compounds. Such compounds include various transition metal carbonyls, other extrudable transition metal and organometallic compounds, and such elements include metals and metal oxides. Upon removal of solvent by air drying and heating or by vacuum, the bead material generally contracts to form a material having a raisin or dried-prune appearance. Thus, where the desired decomposition is affected during solvent gestation, removal of the solvent but retention of the magnetic components generally leads to desired loaded beads which are now contracted in size and have a convoluted surface morphology.

Thermal decompositions of the carbonyls were carried out in solution in round bottom flasks with reflux condensor and heating mantle under dry nitrogen at approximately one atmosphere pressure. All decompositions were carried out in vented hoods. Carbon monoxide effluent was passed through solutions of phosphomolybdic acid in the presence of palladium chloride to afford molybdenum blue and carbon dioxide.

Magnetic measurements were made with a Princeton Applied Research Vibrating Sample Magnetometer, which measures magnetization M, at fields from 0 to 7,000 gauss. The instrument has a sensitivity of better than $1\times10^4$ emu/gauss and the accuracy and resettability of the applied field is within 1 gauss. The system was calibrated with a Ni standard (55.0 emu/gm) in a saturation field of 7 kilogauss. The magnetization, M, is read out digitally directly in electromatic units (emu's). Mass magnetization, $\sigma$, was obtained by dividing M by the sample mass in grams. The samples were contained in cylindrical Kel-F holders approximately $\frac{1}{4}$ inch in diameter and height. The amount of material used, 25 to 35 mg, was varied so that the volume of the sample would remain approximately the same.

EXAMPLE 1

A mixture of about 3 grams of polymer beads (Imbiber Polymer Beads, available from Dow Chemical Company, Midland, Mich. having an average particle diameter of about 100 microns, about 10 ml. of $Fe(CO)_5$, and about 40 ml. of n-octane was refluxed for about 20 hours in a 100 ml. round-bottom flask. After cooling, the solid material was collected by filtration using a sintered glass filter and washed with n-octane, acetone and ethyl ether to remove the fines. The material was dried in a stream of warm air with vibrating motion to prevent particle agglomeration. The average bulk density of the magnetic composite polymer particles is between about 0.6 and about 1.0 gram per cubic centimeter depending on loading content of magnetic component. The composite particles were found to exhibit magnetic properties where magnetism depended on the loading of the magnetic constituent and ranged from between about 10 and about 30 emu/g. for the particles.

EXAMPLE II

A mixture of about 3 grams of polymer beads (Imbiber Polymer Beads, available from Dow Chemical Company, Midland, Mich.) having an average particle diameter of about 350 microns, about 10 ml. of $Fe(CO)_5$, and about 40 ml. of n-octane was refluxed for about 20 hours in a 100 ml. round-bottom flask. After cooling, the solid material was collected by filtration using a sintered glass filter and washed with n-octane, acetone and ethyl ether to remove the fines. The material was dried in a stream of warm air with vibrating motion to prevent particle agglomeration. The average bulk density of the magnetic composite polymer particles is between about 0.6 and about 1.0 gram per cubic centimeter depending on loading content of magnetic component. The composite particles were found to exhibit magnetic properties where magnetism depended on the loading of the magnetic constituent and ranged from between about 10 and about 30 emu/g. for the particles.

EXAMPLE III

A mixture of about 3 grams of polymer beads (Imbiber Polymer Beads, available from Dow Chemical Company, Midland, Mich.) having an average particle diameter of about 550 microns, about 10 ml. of $Fe(CO)_5$, and about 40 ml. of n-octane was refluxed for about 20 hours in a 100 ml. round-bottom flask. After cooling, the solid material was collected by filtration using a sintered glass filter and washed with n-octane, acetone and ethyl ether to remove the fines. The material was dried in a stream of warm air with vibrating motion to prevent particle agglomeration. The average bulk density of the magnetic composite polymer particles is between about 0.6 and about 1.0 gram per cubic centimeter depending on loading content of magnetic component. The composite particles were found to exhibit magnetic properties where magnetism depended on the loading of the magnetic constituent and ranged from between about 10 and about 30 emu/g. for the particles.

EXAMPLE IV

A mixture of about 3 grams of polymer beads (Imbiber Polymer Beads, available from Dow Chemical Company, Midland, Mich.) having an average particle diameter of about 350 microns, about 20 ml. of $Fe(CO)_5$, and about 60 ml. of n-octane was refluxed for about 30 hours in a 250 ml. round-bottom flask. After cooling, the solid material was collected by filtration using a sintered glass filter and washed witn n-octane, acetone and ethyl ether to remove the fines. The material was dried in a stream of warm air with vibrating motion to prevent particle agglomeration. The average bulk density of the magnetic composite polymer particles is between about 0.6 and about 1.0 gram per cubic centimeter depending on loading content of magnetic component. The composite particles were found to exhibit magnetic properties where magnetism depended on the loading of the magnetic constituent and ranged from between about 10 and about 30 emu/g. for the particles.

From these observations, it may be concluded that the thermal decomposition of transition metal carbonyls such as iron pentacarbonyl in the presence of inbibitive polymer substrates produces mechanically and chemically stable composites. In addition, the magnetic behavior observed for these low density magnetic composites ranges from that typical of magnetic iron oxide to that typical of magnetically soft iron. The composites are, therefore, magnetic equivalents to their magnetic constituent yet afford a drastic reduction in density. The composites show good initial magnetic response indicated by a relatively high initial permeability rendering the use of these materials as low density magnetic carrier particles. Further, the various magnetic parameters, such as saturation magnetization, magnetic moment and coercivity of the low density magnetic composite materials can be controlled by varying the starting components. This type of control offers a wide latitude in design parameters not easily achieved with solid or high density magnetic carriers.

Other modifications of the present invention will occur to those skilled in the art upon a reading of the present disclosure. These are intended to be included within the scope of this invention.

I claim:

1. A process for preparing a magnetically responsive, composite electrostatographic carrier particle, said process comprising placing in a suitable vessel particles of an imbibitive polymer material having an average bulk density of between about 0.95 and about 1.05 gram/$cm^3$, a suspending medium, and a transition metal carbonyl selected from iron, cobalt, and nickel carbonyl, excluding air and moisture from said vessel by displacement with a dry inert gas, heating the mixture with agitation to reflux temperature for up to about 24 hours at the temperature of said suspending medium to thermally decompose said transition metal carbonyl whereupon said polymer material is impregnated with the magnetic elemental metal or metal oxide of said transition metal carbonyl, cooling the mixture, washing the composite particle with frresh suspending medium, and diethyl ether, and air drying the composite particle with heat and vibration.

2. A process for preparing a magnetically responsive composite electrostatographic carrier particle in accordance with claim 1 wherein said particles of said polymer material have an average diameter of from between about 10 microns and about 850 microns.

3. A process for preparing a magnetically responsive, composite electrostatographic carrier particle in accordance with claim 1 wherein said polymer material is selected from the group consisting of foam polymer nodules, solid polymer beads, microporous polymer beads, polymer chips, and imbibitive polymer beads.

4. A process for preparing a magnetically responsive, composite electrostatographic carrier particle in accordance with claim 1 wherein said polymer material and said elemental metal are present in a mass ratio of from between about 1:0.3 to 1:1.

5. A process for preparing a magnetically responsive, composite electrostatographic carrier particle in accordance with claim 1 wherein said suspending medium is a hydrocarbon solvent.

6. A process for preparing a magnetically responsive, composite electrostatographic carrier particle in accordance with claim 1 wherein said iron carbonyl is selected from the group consisting of iron pentacarbonyl, diiron nonacarbonyl, tri-iron dodecacarbonyl, and iron carbonyl cluster compounds.

7. A process for preparing a magnetically responsive, composite electrostatographic carrier particle in accordance with claim 1 wherein said cobalt carbonyl is dicobalt octacarbonyl.

8. A process for preparing a magnetically responsive, composite electrostatographic carrier particle in accordance with claim 1 wherein said nickel carbonyl is nickel tetracarbonyl.

9. A process for preparing a magnetically responsive, composite electrostatographic carrier particle in accordance with claim 1 including applying an overcoating of an insulating resin to said composite carrier particle in an amount sufficient to form a thin, substantially continuous film thereon.

10. A process for preparing a magnetically responsive, composite electrostatographic carrier particle, said process comprising placing in a suitable vessel particles of an imbibitive polymer material having an average bulk density of between about 0.95 and about 1.05 gram/cm$^3$, a suspending medium, and a transition metal carbonyl selected from iron, cobalt, and nickel carbonyl, excluding air and moisture from said vessel by displacement with a dry inert gas, heating the mixture with agitation to reflux temperature of said suspending medium to thermally decompose said transition metal carbonyl to its magnetic elemental metal or metal oxide whereby said elemental metal or metal oxide is impregnated in said polymer material, cooling the mixture, washing the composite particle with fresh suspending medium, and diethyl ether and air drying the composite particle with heat and vibration.

* * * * *